US005288118A

United States Patent [19]

Hartselle, III

[11] Patent Number: 5,288,118

[45] Date of Patent: Feb. 22, 1994

[54] BUILDING GUTTER CLEANING IMPLEMENT

[76] Inventor: William Hartselle, III, 15 Woodland Trail, Newnan, Ga. 30263

[21] Appl. No.: 20,708

[22] Filed: Feb. 22, 1993

[51] Int. Cl.[5] ..... A47L 25/00

[52] U.S. Cl. ..... 294/19.1; 15/236.04

[58] Field of Search ..... 294/19.1, 24, 53.5, 294/55; 15/160, 236.04

[56] References Cited

U.S. PATENT DOCUMENTS

| | | | |
|---|---|---|---|
| 2,896,239 | 7/1959 | Bugbird | 294/19.1 X |
| 3,041,655 | 7/1962 | Entler | 294/19.1 X |
| 3,626,542 | 12/1971 | Despain et al. | 294/19.1 X |
| 3,858,267 | 1/1975 | Swannie | 294/19.1 X |
| 4,447,927 | 5/1984 | Malless, Jr. | 294/19.1 X |
| 4,726,090 | 2/1988 | Kilpatrick | 294/19.1 X |
| 5,056,187 | 10/1991 | Higgins | 15/236.04 X |

FOREIGN PATENT DOCUMENTS

| | | | |
|---|---|---|---|
| 1045763 | 1/1979 | Canada | 294/19.1 |
| 7064 | of 1896 | United Kingdom | 294/19.1 |
| 1559925 | 1/1980 | United Kingdom | 294/19.1 |
| 2203212 | 10/1988 | United Kingdom | 15/236.04 |
| 2204105 | 11/1988 | United Kingdom | 15/236.04 |

*Primary Examiner*—David M. Mitchell
*Assistant Examiner*—Dean J. Kramer

[57] ABSTRACT

An implement is described for cleaning the gutters of a building wherein the implement is operated by pulling in a left-to-right or right-to-left scraping and scooping motion by a person standing on the ground. The implement comprises a longitudinal channel body, an inverted "U" shaped connecting bracket, an elongated handle and a pivot connection attaching the bracket to the handle. In the preferred embodiment, a remotely engagable locking feature is provided for the pivot connection and a separate pivotal member with integral end plate is specified to close either end of the channel body thereby forming a scoop.

7 Claims, 3 Drawing Sheets

BUILDING GUTTER CLEANING IMPLEMENT

BACKGROUND OF THE INVENTION (1) Field of the Invention

The present invention generally relates to an improvement in cleaning implements and, more particularly, to a new and novel implement for remotely removing leaves, roofing materials and other debris from overhead gutters of a building.

(2) State of the Prior Art

In order to clean leaves and other debris which become collected in overhead gutters, many cleaning devices have been provided which can be controlled via an elongated handle operated by a person standing on the ground alongside the building. However, such devices are rather complicated in mechanical construction, difficult to use or ineffective in purpose. And some such devices require the use of water under pressure.

One group of such devices has gripping jaws or arms that are mounted on the end of an elongated handle with a means for remote closure such that in operation a clamping action engages a mass of leaves or debris so that such materials may be physically removed from the gutter. Such devices are described in U.S. Pat. Nos. 4,196,927 and 4,310,940. These devices are mechanically complicated, difficult and expensive to manufacture, necessarily heavy and awkward to use. And such devices are inefficient in purpose since some leaves and debris and most fine roofing materials tend to fall away from the load as the device is removed from the gutter.

Another group of such devices consists of scoops of differing configurations mounted on elongated handles for the purpose of scraping and containing leaves and debris and removing them from the gutter. Such devices are described in U.S. Pat. Nos. 3,626,542, 4,319,851 and 4,447,927. Some of these devices are unnecessarily complex, difficult to operate and function when moved in only one direction.

A third type of such devices, as disclosed in U.S. Pat. No. 4,502,806, consists of a scraper that is mounted on an elongated handle and that is moved along the gutter to compacted leaves and debris. This device can be converted to hold a water hose which then washes the debris along the gutter, into the vertical outlet pipe and out the discharge. This device is cumbersome to use and may fail to accomplish its objective if the loosened leaves and debris plug the vertical pipe.

In addition, there are blade-type gutter cleaners, such as disclosed in U.S. Pat. Nos. 4,303,348 and 4,298,224, whose thin blades permit digging and scooping underneath gutter hanging spikes. These devices fail to contain and remove much of the debris in gutters and their movement in a to and fro motion via an elongated handle is awkward and time consuming. A final type of device, as disclosed by U.S. Pat. No. 4,304,498, consists of a ramp-like implement with a water assist for forcing debris up the ramp and out of the gutter.

None of the cleaning implements or devices disclosed by the prior art provide for simple and inexpensive construction, easy use, efficient, thorough and fast cleaning, and the flexibility to reach gutters located over porches and other building extensions.

SUMMARY OF THE INVENTION

It is therefore the main objective of the present invention to provide a building gutter cleaning implement that is simple in construction, efficient in operation, easy and fast to use, operable in either a right to left or left to right direction and that provides the capability for reaching gutters located above porches and other building extensions. Such features are achieved when the present invention is used in coordination with gutters that have been installed without roofing overhang and with exterior hanger brackets which avoid the impediment of gutter hanging spikes.

Generally considered, the gutter cleaning implement of the present invention comprises a longitudinal channel body, a connecting bracket and an elongated handle. The channel body, which is generally "U" shaped in cross section, is positionable longitudinally in the gutter; it has open ends, integrally formed opposite facing sides and bottom and can be formed from thin but flat metal or plastic. Its shape, including its bottom, generally conforms to that of the gutter with one or both sides extending above the gutter. In the preferred embodiment, a pivotable plate closes either end of the channel body to facilitate containing debris as the cleaner is moved along the gutter.

A generally inverted "U" shaped connecting bracket constructed of flat metal bar has one leg turned downward and affixed to the channel body and a second leg turned downward outside of the gutter and attached to the elongated handle. The second leg turns downward at a small angle from vertical so that the operator is positioned away from any falling debris as the cleaner is moved along the gutter and so that shrubbery and other landscaping items located adjacent to the building are avoided.

The elongated handle or pole is attached to the bracket for use in remotely operating the implement. In the preferred embodiment, the elongated handle is attached to the bracket by means of a pivot connection which allows the handle to pivot so that the cleaner can be pulled along the gutter length with ease in either direction. Additionally, the pivot connection permits an operator located on the ground to use the implement to reach gutters located over porches and other building extensions. In the preferred embodiment, the pivot connection has a locking means that can be remotely engaged by lifting the elongated handle vertically. Such locking is desirable to prevent the loaded cleaner body from tipping as it is removed from the gutter and to assist in the removal of debris trapped by the cleaner body against a gutter end.

In operation, the channel body acts as a scoop to scrape and contain debris as the implement is pulled along the gutter.

Additionally, as a part of the present invention, an attachment for the elongated handle comprising a generally inverted "U" shaped member is described for use in cleaning the entrance portions of vertical outlet pipes leading from a gutter.

DESCRIPTION OF THE PREFERRED EMBODIMENT

Referring now to the accompanying drawings, the gutter cleaning implement of the present invention includes a one piece channel body 10 that is constructed of thin but flat stock such as sheet metal or plastic materials. The channel has a bottom 12, opposite facing sides 14 and 16 and open ends.

Figure 1:
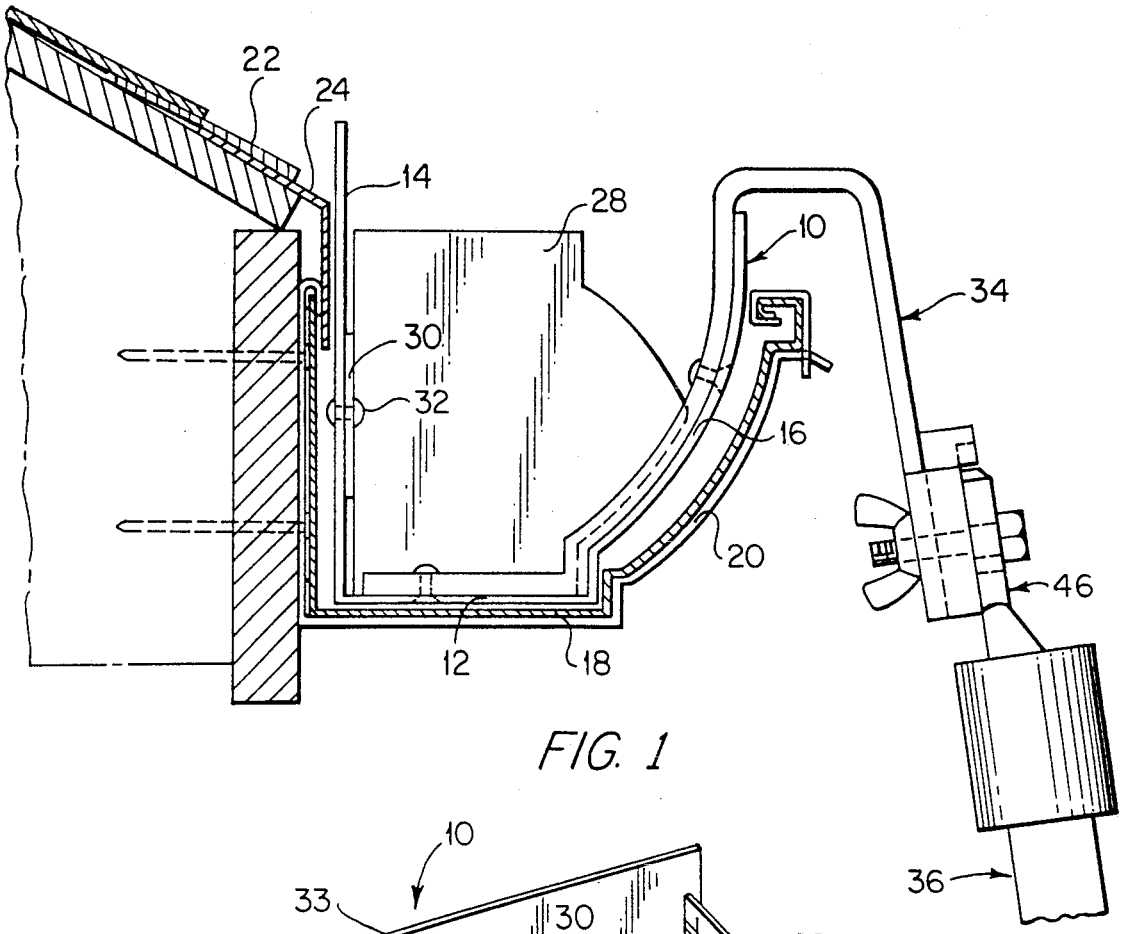
FIG. 1 is a cross sectional elevation view of a building with a gutter showing the gutter cleaning implement of the present invention in working association therewith.

As shown in FIG. 1, the implement of the present invention is used in coordination with a gutter 18 that is installed using exterior hanger brackets 20 to thus avoid the impediment of gutter hanging spikes or straps and, additionally, in coordination with adjacent roofing 22 that is installed to avoid overhang of the gutter. Thin flat sheet metal or plastic 24 that is bent at an angle and installed under the roof covering and into the gutter may be used in terminating the roof 22.

With a gutter 18 as shown in FIG. 1, wherein the cross section has a flat bottom, then the bottom 12 of the channel body of the present invention is flat to conform therewith. However, with a gutter which is generally semicircular or curved in cross section, then the channel body 10 would be of a complementary configuration so that the bottom 12 instead of being flat would be curved.

Figure 2:
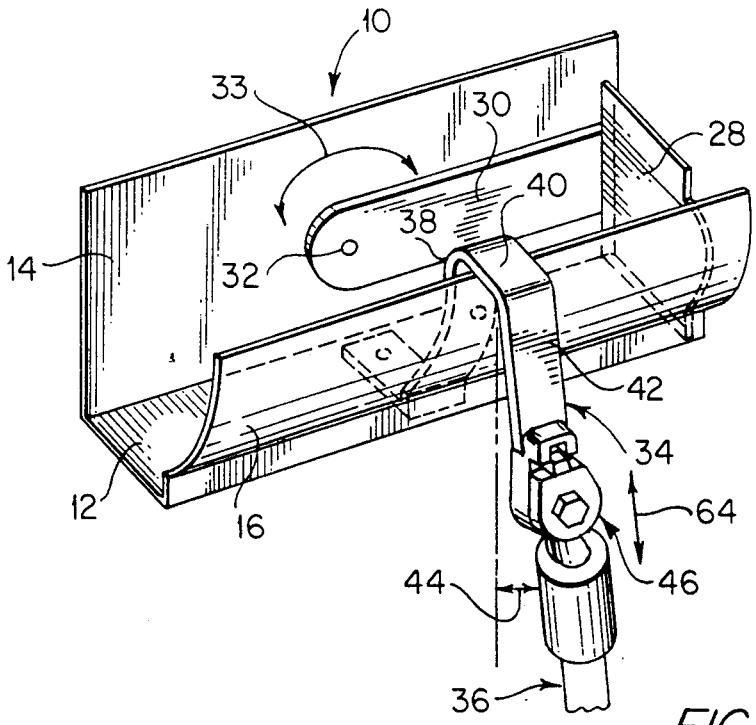
FIG. 2 is perspective view of the gutter cleaning implement.

As shown in FIG. 2, a "L" shaped member formed from thin flat material and comprising an integral arm 30 and perpendicular end plate 28 is provided wherein said arm is pivotably attached 32 to said channel body 10 and wherein said end plate 28, when said "L" shaped member is pivoted 33, serves to close either end of the channel body. As the cleaning implement is moved along the gutter with the end plate 28 positioned at the trailing end of the channel body 10, the plate serves as a back stop to contain and trap leaves and debris.

A generally inverted "U" shaped bracket 34 connects the channel body 10 to an elongated handle 36. The bracket, formed from flat metal bar, has one leg 38 fixedly attached to the channel body, a center section 40 running over the outer gutter side and a second leg 42 turned downward connecting to the elongated handle 36. The second leg 42 turns downward at a small angle 44 from vertical so as to position the operator away from falling debris and away from shrubbery and other landscaping items located adjacent to the building.

The elongated handle 36 is removably attached to the bracket 34 via a pivot connection 46 such that an operator located on the ground may position and operate the implement for the purpose of cleaning the gutter.

Figure 3:
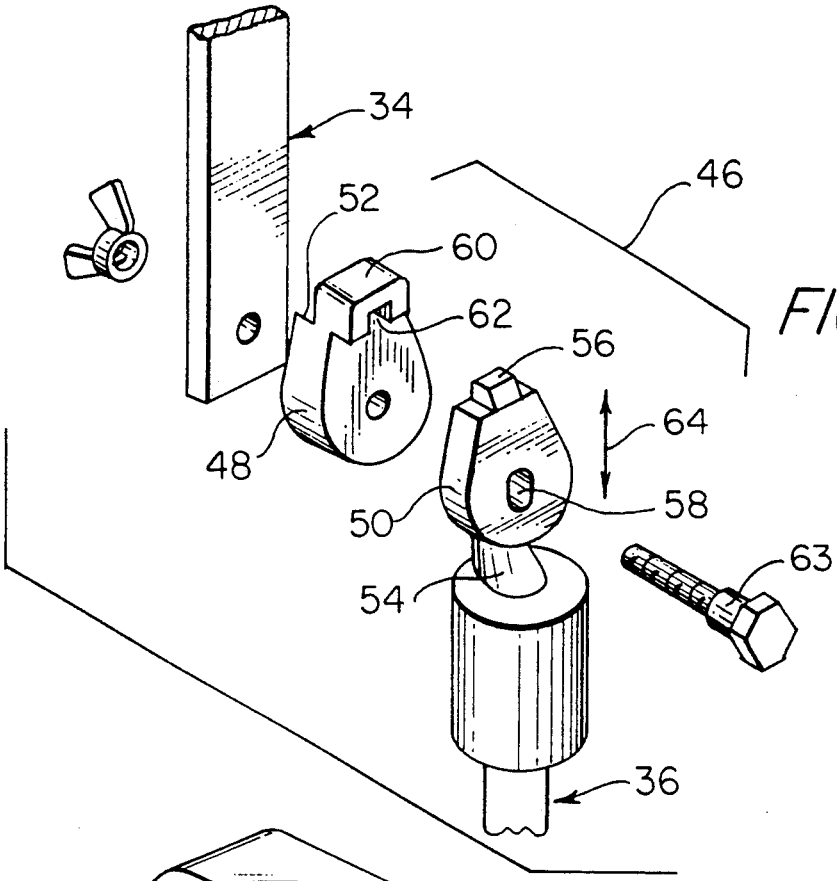
FIG. 3 is an exploded, perspective view of the pivot connection with locking means of the preferred embodiment showing the arrangement of members.

In the preferred embodiment shown in FIG. 3, the pivot connection is comprised of two companion discs 48 and 50 with smooth mating faces wherein the back side of one disc 48 is notched 52 to hold the bracket 34 and wherein the second disc 50 is formed with an appendage 54 for attachment to the elongated handle 36. A bolt or other fastener with an enlarged diameter portion 63 near the head end extends through the hole in each disc and the bracket and is retained by a nut or other retainer. The discs are constructed of cast metal or molded plastic.

To facilitate removal of a loaded cleaner body from the gutter without tipping and to assist in removing debris trapped between the cleaner body and a gutter end, a remotely engagable locking means is provided for the pivot connection. The connection can be locked in such an orientation that the cleaner body is held perpendicular to the elongated handle 36. To accomplish the locking, a tongue 56 is formed on the upper portion of the disc 50 connecting to the elongated handle 36 and a hole 58 at the center of the disc is elongated in a direction opposite that of the tongue. An upward and forward extension 60 of the second disc 48 houses a groove 62 companion to the tongue 56. In normal use, the tongue 56 passes freely under the forward extension 60 of the second disc 48; however, when locking is desired, the handle 36 is placed in the proper orientation and lifted vertically 64 thereby causing the tongue 56 to enter the companion groove 62 and the connection to become locked. Lowering 64 the handle consequently unlocks the connection.

Figure 4:
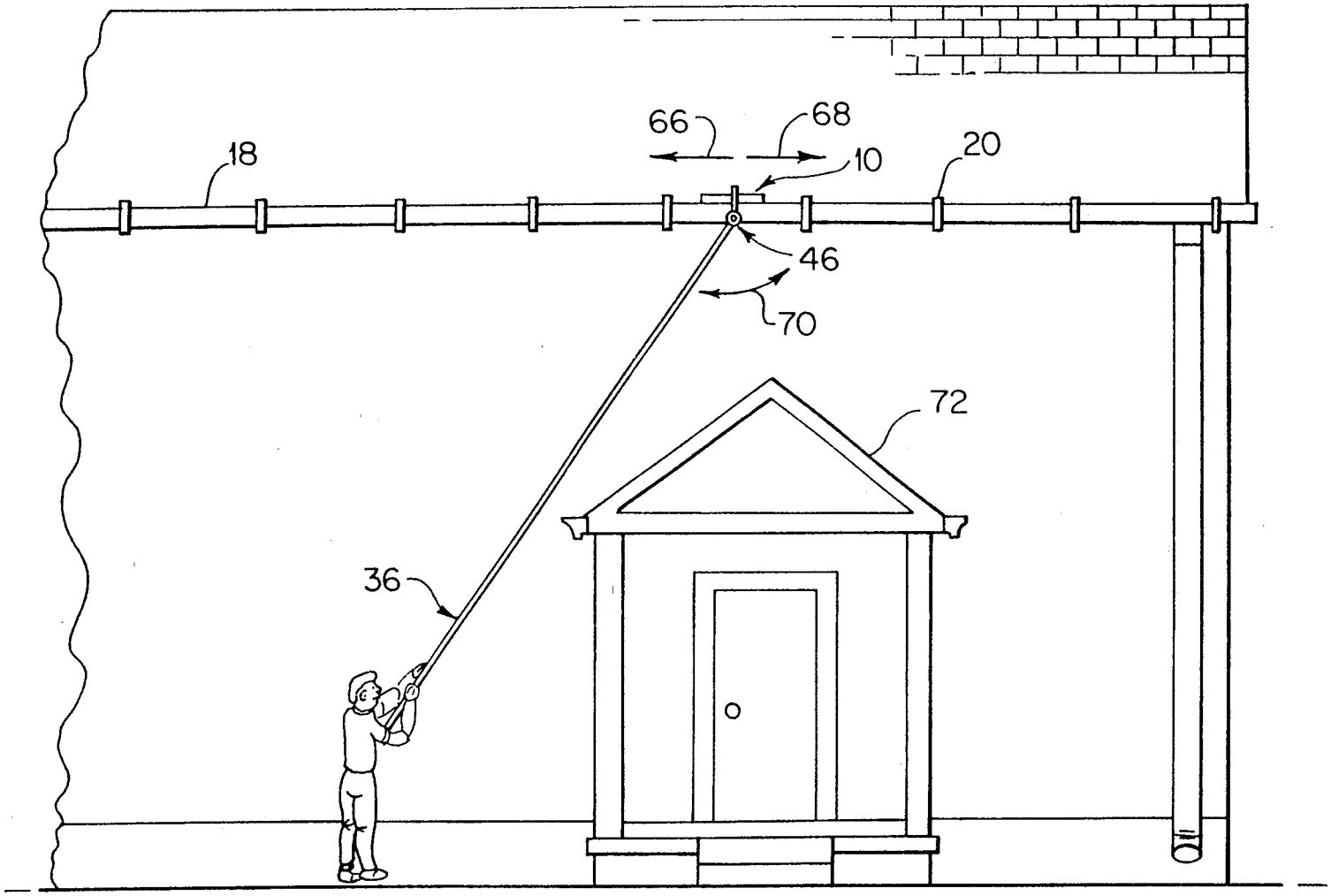
FIG. 4 is an elevation view of the front of a building with a gutter showing an operator using the implement in normal working position within the gutter. The elongated handle is likewise shown in normal working position when the direction of cleaner movement is from right to left.

FIG. 4 shows the elongated handle 36 in normal working position when the cleaning of a gutter 18 supported by exterior hanger brackets 20 is being done in a right to left direction 66; having the handle at an angle to and ahead of the cleaner body 10 greatly improves the operator ease in moving the cleaner along the gutter. When the cleaner movement is in the opposite direction 68, the end plate is pivoted to the other end of the channel body and the handle is pivoted 70 in the opposite direction to again be forward of the cleaner body. As can be observed from FIG. 4, the pivot connection 46 also permits the reaching and cleaning of gutters located above porches 72 and other building extensions.

Figure 5:
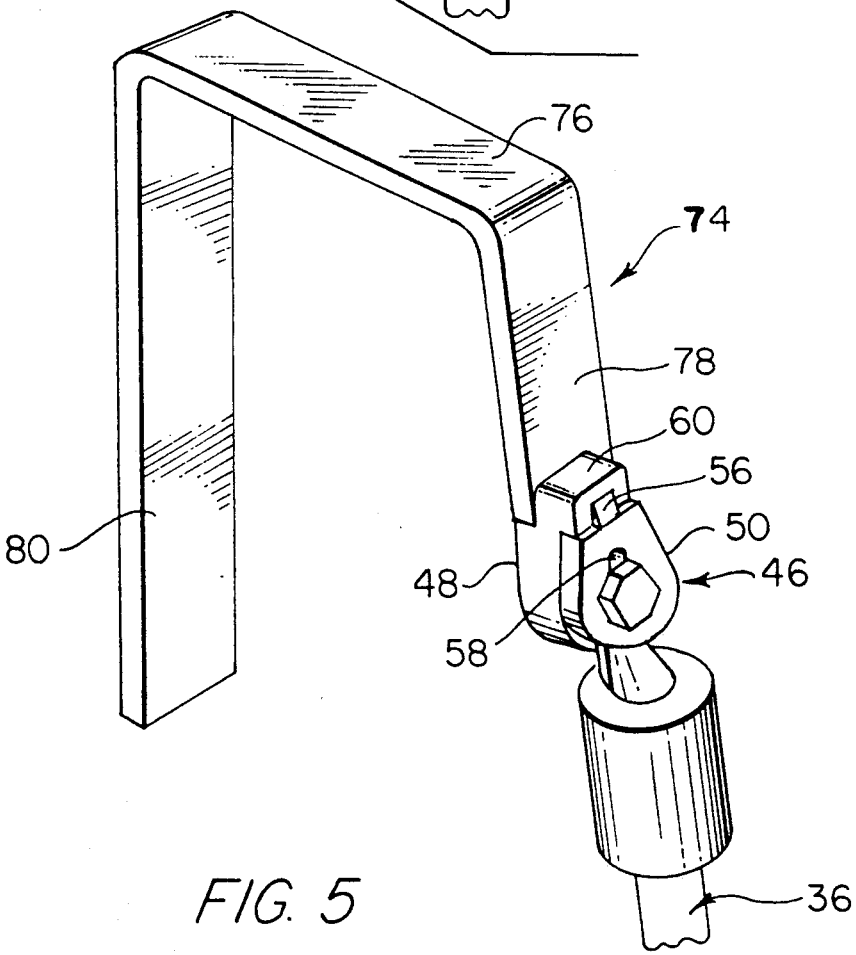
FIG. 5 is a perspective view of an attachment for the elongated handle for use in cleaning entrances to vertical outlet pipes leading from a gutter.

FIG. 5 shows an attachment for the elongated handle 36 for use in cleaning the entrance portions of vertical outlet pipes leading from a gutter. This attachment is a generally inverted "U" shaped member 74 formed from metal bar and comprising a center section 76 and two legs. A first leg 80 of the member extends into the gutter and further into the entrance portion of a vertical outlet pipe and, in operation, is used to crush and dislodge leaves, twigs and other debris that may obstruct the outlet. Such dislodged debris may then fall through the vertical pipe and be swept completely out with the next flow of water. The second leg 78 of the "U" shaped member 74 is removably attached to the previously described elongated handle 36 via the previously described pivot connection 46 wherein such pivot connection is rigidly held in a locked position by a bolt and nut or other fastening means.

It can thus be seen that the present invention provides a simple, effective, easily operated and highly versatile implement for the scraping and cleaning of building gutters.

While the best known form of the present invention has been described herein and shown in the accompanying drawings, it is to be understood that such is for exemplary purposes only and that the invention is only limited by the scope and spirit of the appended claims.

What is claimed is:

1. An implement for cleaning the gutter of a building comprising:

(a) a main channel body positionable longitudinally in the gutter which channel body has integrally formed opposite facing sides, a bottom and open ends, (b) a bracket affixed to said channel body whose integral segments extend upward, outward and then downward, (c) an elongated handle and (d) a pivot means connecting said bracket to said elongated handle whereby said elongated handle is movable in a plane parallel to the longitudinal axis of said channel body.

2. The implement according to claim 1 wherein said pivot connection includes a locking means which can be operated remotely by movement of said handle.

3. The implement according to claim 2 further comprising an "L" shaped member including an integrally formed arm and perpendicular end plate wherein said arm is pivotably attached to said channel body and wherein said end plate, when said member is pivoted, serves to close either end of said channel body.

4. The implement according to claim 3 wherein said downward extending segment of said bracket extends downward at a small angle from vertical.

5. The implement according to claim 4 wherein the cross-sectional shape of said channel body generally conforms to the cross-sectional shape of the gutter.

6. The implement according to claim 5 wherein the lower half of said end plate is of a shape to conform to the cross-sectional shape of said channel body and the upper half of said end plate is of a shape to conform to the cross-sectional shape of said channel body when said "L" shaped member is pivoted to the opposite end of said channel body.

7. The implement according to claim 6 wherein at least one side of said channel body extends above the top edge of the gutter to be cleaned.

* * * * *